US011116253B2

(12) United States Patent
Richmond et al.

(10) Patent No.: US 11,116,253 B2
(45) Date of Patent: Sep. 14, 2021

(54) INNER CORE ELEMENT FOR USE WITH ELECTRONIC CIGARETTE

(71) Applicant: Banana Bros, LLC, Culver City, CA (US)

(72) Inventors: David Richmond, Culver City, CA (US); Howard Richmond, Los Angeles, CA (US)

(73) Assignee: Banana Bros, LLC, Culver City, CA (US)

( * ) Notice: Subject to any disclaimer, the term of this patent is extended or adjusted under 35 U.S.C. 154(b) by 0 days.

(21) Appl. No.: 16/559,567

(22) Filed: Sep. 3, 2019

(65) Prior Publication Data

US 2021/0068459 A1 Mar. 11, 2021

(51) Int. Cl.

| | |
|---|---|
| ***A24F 40/46*** | (2020.01) |
| ***H05B 3/03*** | (2006.01) |
| ***H05B 1/02*** | (2006.01) |
| ***A24F 40/10*** | (2020.01) |

(52) U.S. Cl.

CPC ..... *A24F 40/46* (2020.01); *A24F 40/10* (2020.01); *H05B 1/0297* (2013.01); *H05B 3/03* (2013.01)

(58) Field of Classification Search

None

See application file for complete search history.

(56) References Cited

U.S. PATENT DOCUMENTS

| | | | | |
|---|---|---|---|---|
| 2015/0351159 | A1* | 12/2015 | Kamijo | H05B 3/145 264/674 |
| 2017/0071030 | A1* | 3/2017 | Schlipf | H05B 3/48 |
| 2018/0279680 | A1* | 10/2018 | Rashid | A61M 15/06 |
| 2018/0296777 | A1* | 10/2018 | Terry | A24F 40/44 |
| 2019/0059439 | A1* | 2/2019 | Richmond | A24B 7/04 |
| 2020/0229510 | A1* | 7/2020 | Griscik | A61K 9/007 |
| 2020/0305503 | A1* | 10/2020 | Chen | A24F 40/40 |
| 2021/0068459 | A1* | 3/2021 | Richmond | H05B 3/04 |

* cited by examiner

*Primary Examiner* — James Harvey

(74) *Attorney, Agent, or Firm* — Smyrski Law Group, A P.C.

(57) ABSTRACT

An electronic cigarette comprising an atomizer is provided. The electronic cigarette includes an inner core assembly configured to receive liquid and provide the liquid through at least one opening in the inner core assembly. The inner core assembly includes a heater having a noncylindrical shape, in one embodiment having hexagonal shape in a sinusoidal wave pattern with rounded corners.

20 Claims, 8 Drawing Sheets

INNER CORE ELEMENT FOR USE WITH ELECTRONIC CIGARETTE

BACKGROUND

I. Field

The present invention relates generally to substitutes for cigarette smoking, and more particularly, to components employed in electronic cigarettes.

II. Background

Smoking cigarettes is enjoyed in many corners of modern society. In some circles, alternatives to cigarettes have developed significant interest. Electronic cigarettes have been produced and are believed by some to provide certain advantages over cigarette smoking, with advantages mentioned including avoiding tobacco smoke impurities such as carbon monoxide, ash, and tar.

Various types of electronic cigarettes are currently available. Some electronic cigarettes include atomizers. In an electronic cigarette employing an atomizer, liquid solution flows into a central tube and a heater heats and atomizes the liquid. Such a device has in the past included a detachable inner core assembly that facilitates the flow of liquid. The detachable inner core is typically porous and essentially or substantially cylindrical, or in other words hollow and circular in cross section, with holes provided in the sides to allow the flow of oil toward the heater.

Issues with the detachable inner core assembly of electronic cigarettes employing heaters and/or other types of atomizers include the necessity for a layer of cotton or similar substance, typically outside the heater assembly, that acts as a filter and a wick that prevents the liquid from leaking out of the holes or airway. One issue with this arrangement is that in a heating situation, time is of the essence. It is best to provide the liquid as quickly and efficiently as possible toward the heater. The shape and arrangement of the cylindrical assembly and encircling layer of cotton results in the oil passing relatively slowly toward the heater. This provides for a relatively low level of vaporization. Further, the presence of cotton in such a design can introduce impurities, can be prone to leaking, and cotton when heated can provide a flavor that has a burned taste. Another issue with the need for a cotton layer is that more power may be required from the battery in the presence of slow heating or slow passage of liquid, which is undesirable. A residue can sometimes build up in the device, in the cotton wick or in other parts of the device, which may be difficult to remove and is generally undesirable.

It would be beneficial to provide a device that quickly and efficiently transmits oil to a central heating and atomizing element, and preferably one that avoids the issues with the cotton wick and resultant burned flavor. Further, such a design would benefit from higher efficiency transmission of liquid to a heater/atomizer in an electronic cigarette. Such a design that overcomes issues with prior devices would be beneficial, and thus improve the user experience with such products.

SUMMARY

The following presents a simplified summary in order to provide a basic understanding of some aspects of the claimed subject matter. This summary is not an extensive overview and is not intended to identify key/critical elements or to delineate the scope of the claimed subject matter. Its sole purpose is to present some concepts in a simplified form as a prelude to the more detailed description that is presented later.

According to an embodiment of the present design, there is provided an electronic cigarette comprising an atomizer, the electronic cigarette comprising an inner core assembly configured to receive liquid and provide the liquid through at least one opening in the inner core assembly. The inner core assembly comprises a heater having a noncylindrical shape.

According to another embodiment there is provided an electronic cigarette comprising an atomizer, the electronic cigarette comprising an inner core assembly configured to fit within the electronic cigarette, the inner core assembly configured to receive liquid and provide the liquid through at least one opening formed therein. The inner core assembly comprises a heater having a noncylindrical cross section.

According to a further embodiment, there is provided an electronic cigarette comprising an atomizer, the electronic cigarette comprising an inner core assembly configured to fit within the electronic cigarette, the inner core assembly configured to receive liquid and provide the liquid through at least one opening formed therein. The inner core assembly comprises a heater having a noncylindrical cross section and connections from the heater to the electronic cigarette.

To the accomplishment of the foregoing and related ends, certain illustrative aspects are described herein in connection with the following description and the annexed drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings.

DETAILED DESCRIPTION

In this document, the words "embodiment," "variant," and similar expressions are used to refer to particular apparatus, process, or article of manufacture, and not necessarily to the same apparatus, process, or article of manufacture. Thus, "one embodiment" (or a similar expression) used in one place or context can refer to a particular apparatus, process, or article of manufacture; the same or a similar expression in a different place can refer to a different apparatus, process, or article of manufacture. The expression "alternative embodiment" and similar phrases are used to indicate one of a number of different possible embodiments. The number of possible embodiments is not necessarily limited to two or any other quantity.

The word "exemplary" is used herein to mean "serving as an example, instance, or illustration." Any embodiment or variant described herein as "exemplary" is not necessarily to be construed as preferred or advantageous over other embodiments or variants. All of the embodiments and variants described in this description are exemplary embodiments and variants provided to enable persons skilled in the art to make or use the invention, and not to limit the scope of legal protection afforded the invention, which is defined by the claims and their equivalents.

The present design comprises an apparatus usable in an electronic cigarette/vaporizer that includes a heating element and is specifically drawn to an inner core element comprising a heater shaped in a beneficial way that obviates the need for a cotton wick being positioned around the heater or heating element. The shape of the element can vary, with one embodiment including a six position semi-sinusoidal cross section. Such a design provides a larger surface area that results in more contact with the liquid provided. The inner core disclosed herein is lighter in mass than inner core elements previously provided, and furthermore, no wick is required. Other heating element shapes may be provided, with the overall benefit being the increase in surface area available to facilitate rapid passage of liquid to the heater without need for a cotton wick or filter.

Figure 1:
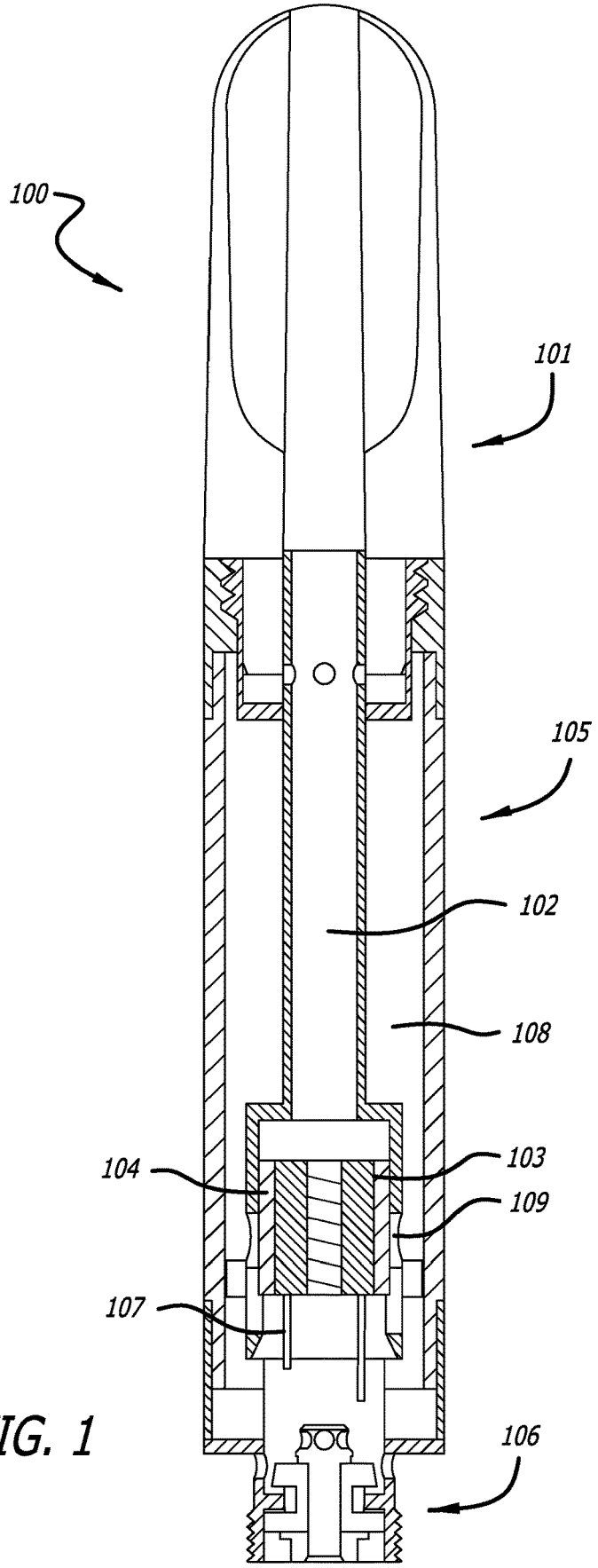
FIG. 1 illustrates an example of an electronic cigarette that employs an atomizer.

FIG. 1 shows an overall design that may employ the present design. From FIG. 1, electronic cigarette 100 includes an exterior shell 101 with an internal air path 102 or chimney where air passes through. Ceramic heater 103 is provided, a generally cylindrical element surrounded by, in this design, cotton wick 104. Liquid is maintained within liquid reservoir assembly 105 and an atomizer assembly 106 is provided. Electrical connections such as electrical connection 107 are provided with ceramic heater 103. The liquid reservoir assembly 105 includes a liquid reservoir chamber 108 that maintains liquid solution, such as an oil or other liquid. An inlet hole 109 is provided enabling liquid to pass from liquid reservoir chamber 108 to cotton wick 104 and ceramic heater 103. Liquid or oil passes from liquid reservoir chamber 108 through holes, such as inlet hole 109, through cotton wick 104 to heater 103, where heat atomizes the oil and forms a gas, and the gas passes through internal air passage or chimney 102 out of the electronic cigarette 100 and to the user.

Figure 2A:
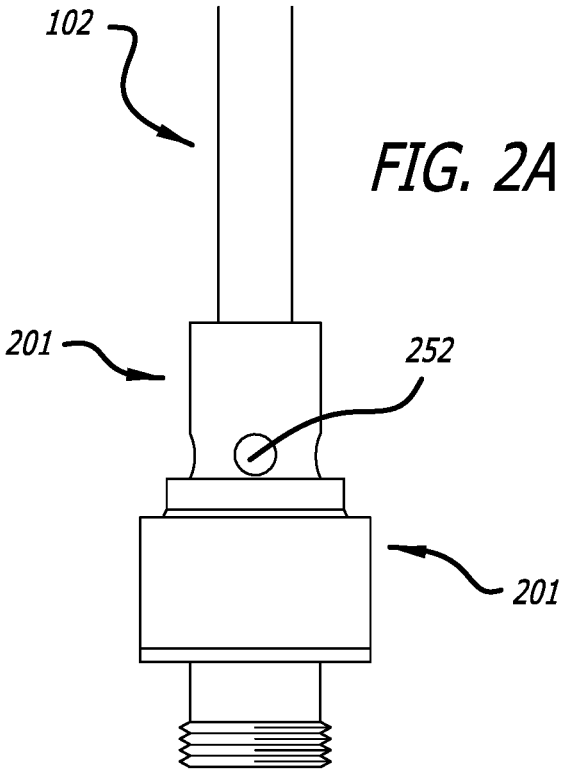
FIG. 2A is a side view of a portion of an electronic cigarette with atomizer including components from the apparatus of FIG. 1.

FIG. 2A illustrates a view of an inner core assembly employed in the device of FIG. 1. From FIG. 2A, air path 102 or chimney is connected to a connection member 201 that includes an oil inlet hole 202. The connection member 201 may be screwed into or otherwise attached to lower connection member 203.

Figure 2B:
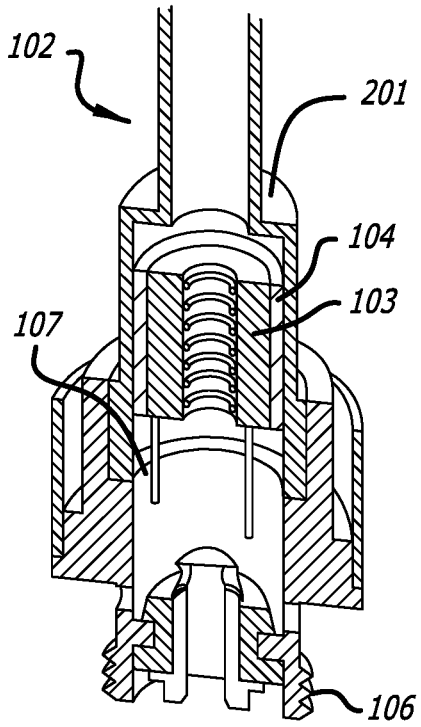
FIG. 2B is a perspective view of inner components of the device.

FIG. 2B shows a perspective cross sectional view of the device of FIG. 1, with air path 102 shown atop connection member 201. Within connection member 201 is ceramic heater 103, surrounded by cotton wick 104. Resistance wire 107 emanates from ceramic heater 103. At the base of the device is atomizer assembly 106. The position and number of the liquid inlet holes may vary. In some embodiments, parts such as air path 102 may be made of metal and may have a relatively high level of rigidity. Other members may also be made of metal.

Figure 2C:
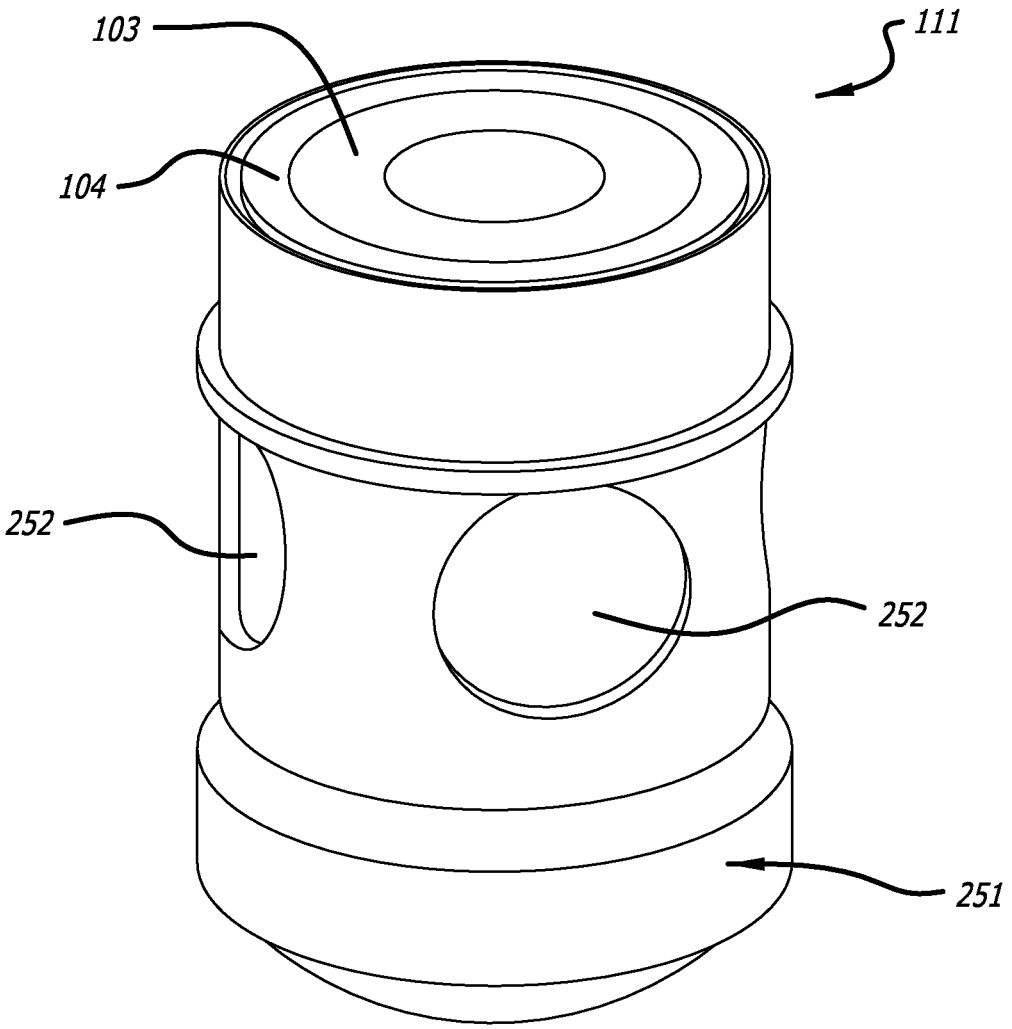
FIG. 2C is a representation of an inner core assembly including cylindrical cross section elements, including a cylindrical heating element.

FIG. 2C illustrates an inner core assembly including components of particular interest in the present design. From FIG. 2C, a fixing tube is provided that maintains the heater 103 and other elements and together these parts form inner core assembly 251. Ceramic heater 103 is surrounded by a liquid absorbing member or cotton wick 104 within inner core assembly 251. Holes 252 are shown in the fixing tube in this view.

The devices of FIGS. 2A through 2C may be made of different materials, including but not limited to metals, composites, polymers, and plastics. Care must be taken with the design as it employs heat and engaging the heater for long periods of time can harm or be detrimental to certain materials, and users may be harmed if care in heating is not taken. In general, hard plastic and composite materials may be employed in components where heating is low, while ceramics or certain other heat resistant or insulating materials may be employed in areas tending to heat up over time.

The liquid absorbing member, shown as cotton wick 104, can be a tubular liquid absorbing sponge, a tubular porous ceramic body, or a combination of the tubular porous ceramic body and the liquid absorbing sponge enclosing the porous ceramic body. Ceramic heater 103 can be a heating coil, a heating film, or other heating components arranged inside the liquid absorbing member or cotton wick 104. Once the liquid solution absorbed by the cotton wick 104 is vaporized, smoke flows to one end of the air path 102.

The resultant shape of the combined ceramic heater 103 and cotton wick 104 is thus generally cylindrical, offering a limited amount of liquid transfer capability and requiring use of a material such as cotton and the aforementioned issues presented with such a design.

Figure 3A:
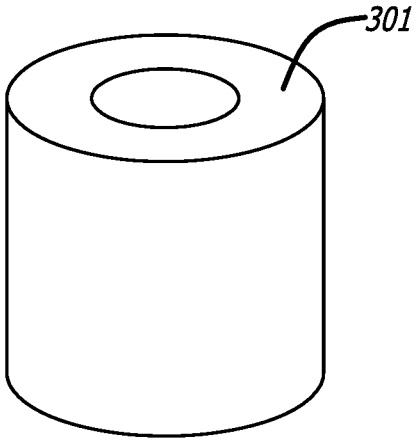
FIG. 3A (Prior Art)
FIG. 3A is a representation of a cylindrical heater used in previous designs.
Figure 3B:
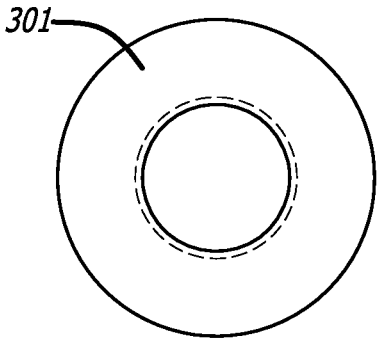
FIG. 3B (Prior Art)
FIG. 3B is a further representation of a cylindrical heater used in previous designs.
Figure 4A:
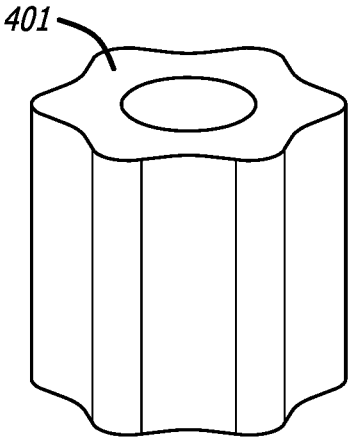
FIG. 4A shows an embodiment of a heater according to the present design having decreased volume and increased surface area.
Figure 4B:
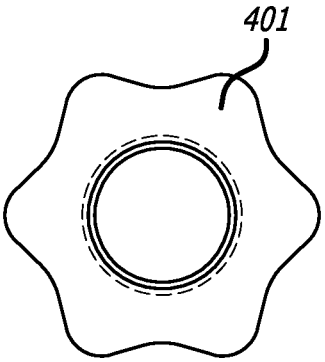
FIG. 4B is a further representation of the embodiment of the heater according to the present design having decreased volume and increased surface area.

FIGS. 3A and 3B are representations of the design discussed above and specifically the heater 301 employed in the design discussed. FIGS. 4A and 4B illustrate the alternate heater design provided herewith. This alternate heater design obviates the need for a cotton element and provides greater surface area than the design of FIGS. 3A and 3B. From FIGS. 4A and 4B, heater 401 has in this embodiment a hexagonal shape, with six protrusions and an equal number of indentations, in a pattern similar to a sine wave. Protrusion 402 is identified in FIGS. 4A and 4B. The use of the wave pattern around the periphery enables ceramic heater 401 to fit in the same space as the device of FIGS. 3A and 3B with a reduced volume. The design of FIGS. 4A and 4B facilitates and provides increased contact with liquid provided as a result of increased surface area. The reduced volume of the heater 401 facilitates faster heating and a more rapid vaporization of the liquid. The smaller overall volume conserves battery power in the device.

Total volume of a device similar to that shown in FIGS. 3A and 3B that fits in the apparatus of FIG. 1 is on the order of 68.28 cubic centimeters, while the total volume of the ceramic heater of FIGS. 4A and 4B is on the order of 49.40 cubic centimeters, a decrease in volume of over 27 percent. Total surface area, on the other hand, increases from 141.513 cubic millimeters for the FIGS. 3A and 3B design to 153.368 cubic millimeters for the FIGS. 4A and 4B design, an increase of over 7.5 percent. The design of FIGS. 4A and 4B may employ a thermo expanding seal, or a thermo-sensitive seal that expands and contracts to dynamically prevent leaks. The heater design of FIGS. 4A and 4B may include, for example, odorless and flavorless food grade silicon. The resultant device having smaller volume thus rapidly heats up and requires less power from the battery.

Figure 5A:
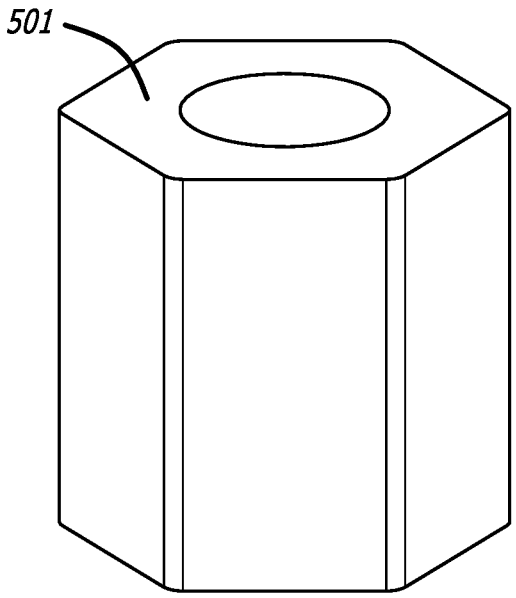
FIG. 5A an alternate hexagonal shaped heater, again having decreased volume and increased surface area.
Figure 5B:
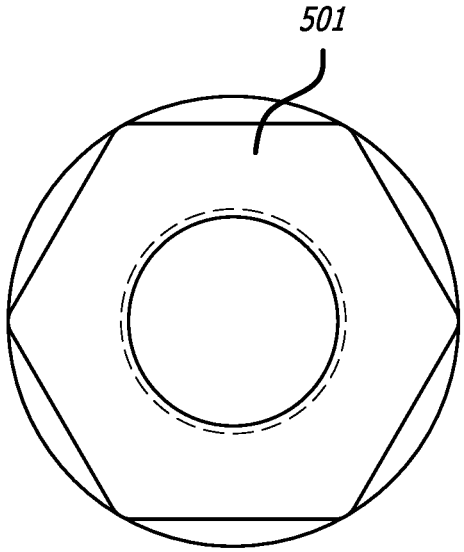
FIG. 5B is a further representation of the alternate hexagonal shaped heater.

While shown as a hexagonal design in FIGS. 4A and 4B, other designs may be successfully employed. The goal is for the device to fit within the apparatus of FIG. 1 or a similar device with a decreased volume but increased surface area that obviates the need for a cotton wick or elements comprising cotton or similar materials. FIGS. 5A and 5B show an alternate embodiment that includes an alternate hexagonal shape with slightly rounded edges. Irregular dimensions may be employed in the heater design, but in all cases, the heater is non-circular in cross section, or non-cylindrical in the entirety.

Figure 6A:
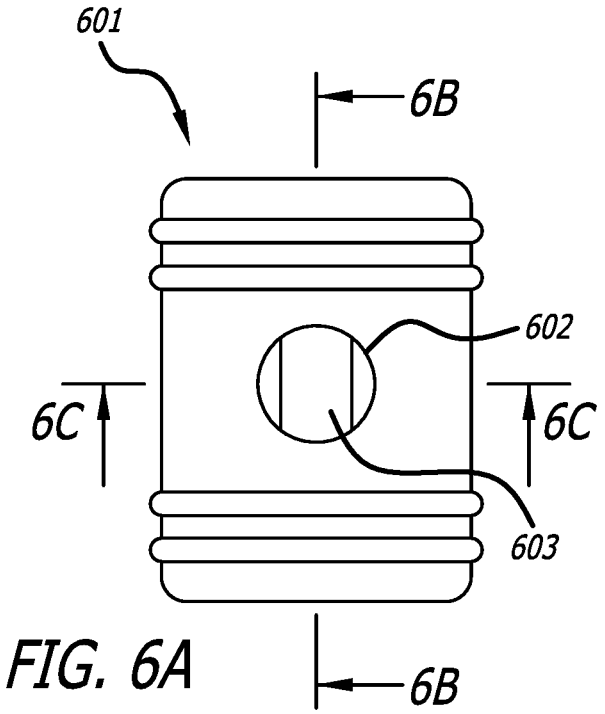
FIG. 6A shows a representation of an inner core assembly or holder including a hole through which the heater may be seen.
Figure 6B:
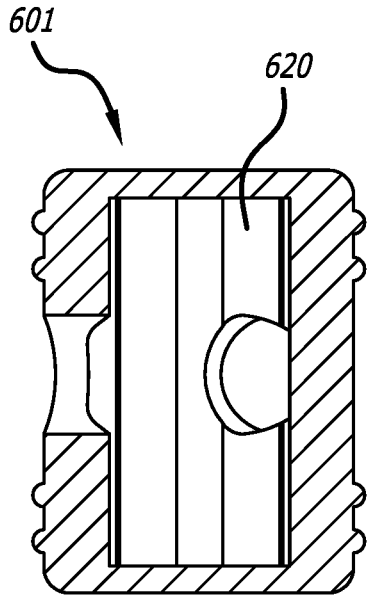
FIG. 6B is a cutaway view according to line A-A in FIG. 6A.
Figure 6C:
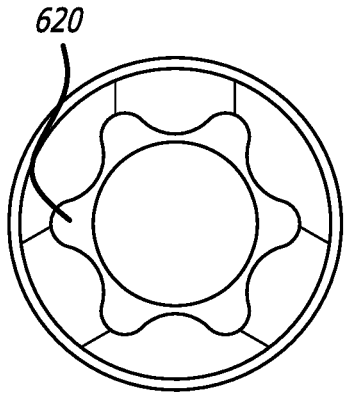
FIG. 6C illustrates a cutaway view along line B-B in FIG. 6A showing one embodiment of the heater of the present design.
Figure 6D:
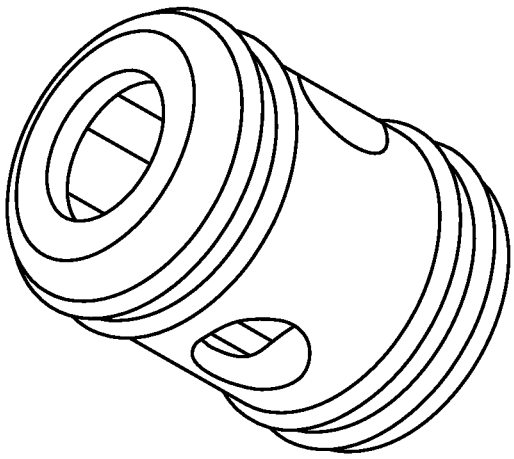
FIG. 6D is a perspective view of one embodiment of the current design.

FIG. 6A shows an exterior representation of a device similar to inner core assembly 250. Such a device can fit into and be usable in the device of FIG. 1. The holder 601 in FIG. 6A includes an opening or hole 602 through which, in this illustration, one element 603 of the heater can be seen. A number of ridges can be seen, a total of four ridges formed on the exterior of holder 601, including ridge 604. FIG. 6B shows a cross section according to line A-A of FIG. 6A, while FIG. 6C shows a cross section along lines B-B of FIG. 6A, including heater 620, separated from the inner sides of holder 601 and smaller in mass but larger in surface area than heaters previously employed. FIG. 6D is a perspective view of this embodiment.

Figure 7A:
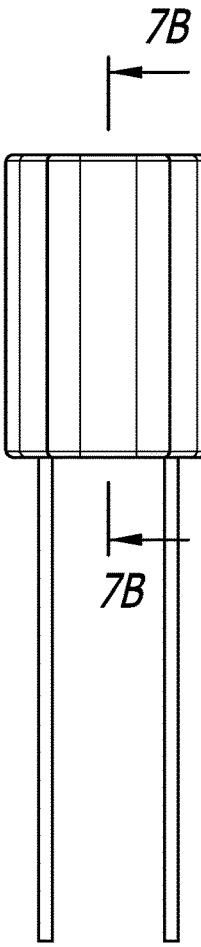
FIG. 7A is an elevation view of an embodiment of the present heater.
Figure 7B:
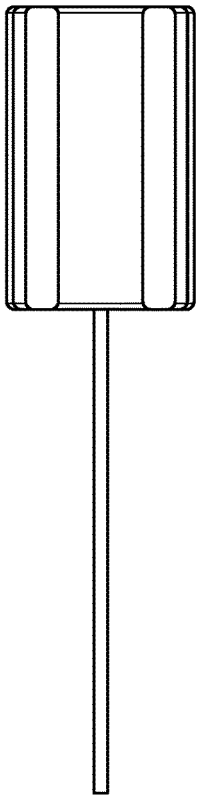
FIG. 7B is a cutaway view of an embodiment of the heater along lines A-A in FIG. 7A.
Figure 7C:
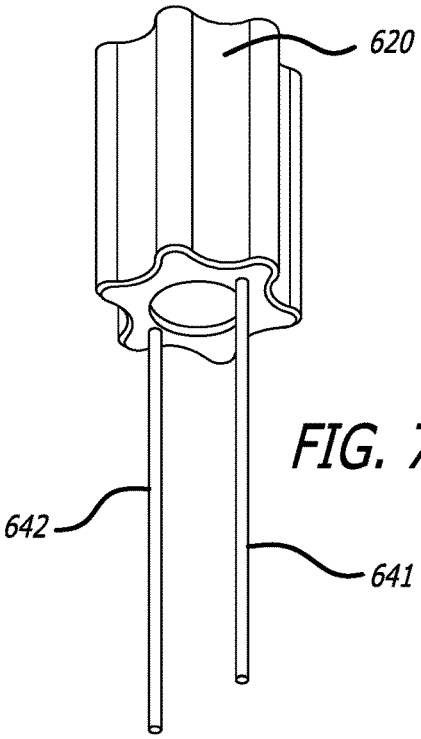
FIG. 7C is a perspective view of an embodiment of the heater according to the present design.

FIG. 7A is a side view of heater 620, with FIG. 7B a cutaway view along the line A-A in FIG. 7A. FIG. 7C is a perspective view of heater 620, including electrical lines 641 and 642.

Corners of the heater are typically softly rounded to prevent cracking. While shown in FIGS. 6A through 6D as gaps or spaces being provided between the heater 620 and the holder 601, different spacing or gaps or no spacing or gaps may be provided. Any number of sides and/or protrusions may be provided on or with heater 620, such as anything from three to nine sides, and the heater may take on different forms, such as one portion, such as an upper portion of the heater being a first shape and a lower portion being a second shape.

In certain constructions, the ceramic porosity, representing the ratio of holes or openings in the external holding element, may be on the order of 10 or 11 percent open air and 89 or 90 percent ceramic. This does not include the air shaft, or the holes formed at the top and bottom of the holding element. Thus 10 or 11 percent of the sides are open, while 89 or 90 percent are closed. Other embodiments, such as 15 percent closed and 85 percent open, are possible.

For the heater, the range of resistance is typically 0.3 to 8.0 ohms in a construction that fits within the design presented. One to six ohms may be employed running up and down the heater at the center for air flow to successfully pass through the apparatus.

Figure 8A:
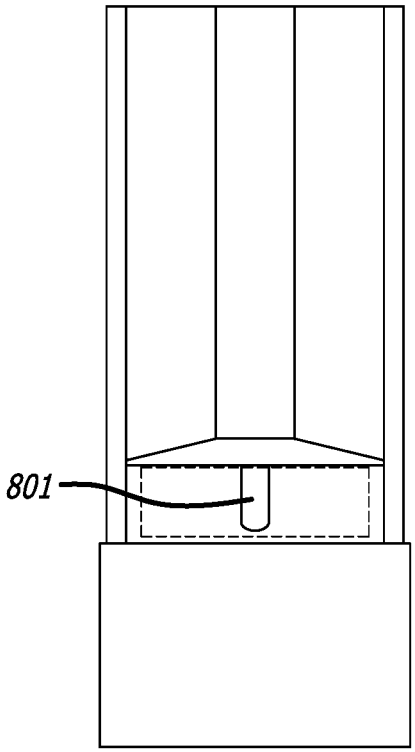
FIG. 8A illustrates an alternate embodiment of the design employing U-shaped holes useful in avoiding liquid buildup.
Figure 8B:
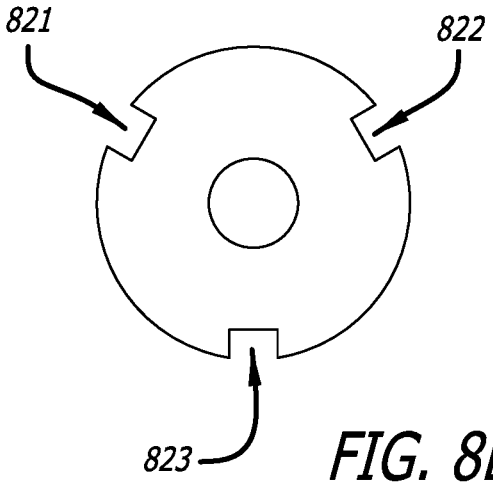
FIG. 8B is a cross section of the device of FIG. 8A.
Figure 8C:
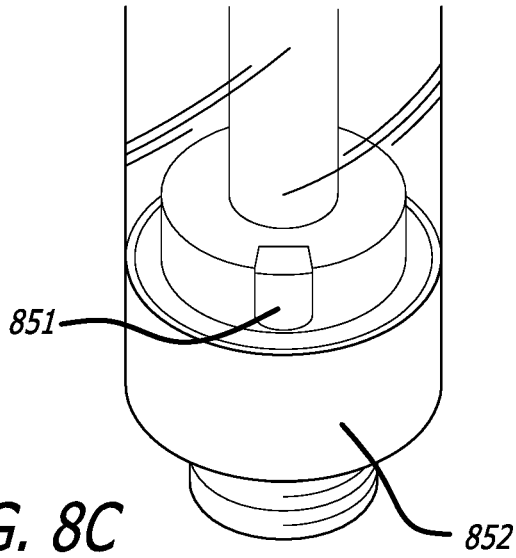
FIG. 8C is a perspective view of a device including U-shaped holes as suggested by the design of FIG. 8A.

As noted, holes may be located in different positions. In certain embodiments, holes are located on the side of the ceramic heater 103 and the oil or liquid enters from sides only. In such a design, a sloped base floor of the tank is provided that funnels liquid down into smaller channels that is then directly fed to the heater so minimal oil is left at the bottom of the device against the walls. Such a construction minimizes liquid buildup in the device. FIG. 2A shows a design with circular relatively high holes that may result in a buildup of liquid. FIG. 8A illustrates one representation of lower, U-shaped holes such as hole 801. FIG. 8B is a cross section of the device with the alternate hole design showing three holes 821, 822, and 823, while FIG. 8C is an illustration of such a design where the bottom of the "U" for each hole is very low in the device in the orientation shown and low within a connection member 851 similar to lower connection member 203 of FIG. 2. Such a low hole, with the bottom of the "U" being low in the device, allows liquid or oil to pass toward ceramic heater 103, where such a heater has the beneficial form disclosed herein and does not include a liquid absorbing member such as a cotton wick.

Thus the present design includes a heater employable in an electronic cigarette and atomizer device, such as those already existing, the heater employing a non-cylindrical shape that provides a decreased volume but increased surface area and obviates the need for a cotton wick or elements comprising cotton or similar materials around or near the heater. In one embodiment, the heater has a hexagonal shape, while other shapes are possible, but in all cases the heater is non-cylindrical. The heater may be sized smaller than an enclosure provided, such as an inner core assembly or other holder or holding element, such as a holding element comprising holes. In certain embodiments, the size of the holes and the resistance of the heater are at established values for facilitating the heating and atomizing process. It had been previously unknown to those skilled in the art how to employ less power and obtain more rapid heating without the adverse effects of cotton in such a device.

According to an embodiment of the present design, there is provided an electronic cigarette comprising an atomizer, the electronic cigarette comprising an inner core assembly configured to receive liquid and provide the liquid through at least one opening in the inner core assembly. The inner core assembly comprises a heater having a noncylindrical shape.

In another embodiment there is provided an electronic cigarette comprising an atomizer, the electronic cigarette comprising an inner core assembly configured to fit within the electronic cigarette, the inner core assembly configured to receive liquid and provide the liquid through at least one opening formed therein. The inner core assembly comprises a heater having a noncylindrical cross section.

According to a further embodiment, there is provided an electronic cigarette comprising an atomizer, the electronic cigarette comprising an inner core assembly configured to fit within the electronic cigarette, the inner core assembly configured to receive liquid and provide the liquid through at least one opening formed therein. The inner core assembly comprises a heater having a noncylindrical cross section and connections from the heater to the electronic cigarette.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The invention claimed is:

1. An electronic cigarette comprising an atomizer, the electronic cigarette comprising an inner core assembly configured to receive liquid and provide the liquid through at least one opening in the inner core assembly, the inner core assembly comprising:

a heater having a noncylindrical shape;

wherein the heater is formed of ceramic.

2. The electronic cigarette of claim 1, wherein the heater has a hexagonal shape comprising rounded corners.

3. The electronic cigarette of claim 1, wherein the heater is remote from an inner surface of the inner core assembly.

4. The electronic cigarette of claim 1 wherein liquid passing through the at least one opening contacts the heater and the heater atomizes the liquid.

5. The electronic cigarette of claim 1, wherein the heater comprises two electronic contacts.

6. The electronic cigarette of claim 1, wherein the heater has a hexagonal shape with rounded corners in an external sinusoidal shape.

7. The electronic cigarette of claim 1, wherein holes comprise 10 or 11 percent of the inner core assembly and ceramic comprises 89 or 90 percent excluding upper and lower openings.

8. The electronic cigarette of claim 1, wherein the heater has between three and nine sides and has rounded corners.

9. An electronic cigarette comprising an atomizer, the electronic cigarette comprising an inner core assembly configured to fit within the electronic cigarette, the inner core assembly configured to receive liquid and provide the liquid through at least one opening formed therein, the inner core assembly comprising:

a heater having a noncylindrical shape and a noncircular cross section;

wherein the heater is formed of ceramic.

10. The electronic cigarette of claim 9, wherein the heater has a hexagonal cross section with rounded corners.

11. The electronic cigarette of claim 9, wherein the inner core assembly comprises ceramic.

12. The electronic cigarette of claim 9, wherein the electronic cigarette is free of a liquid absorbing member positioned between the heater and the inner core assembly.

13. The electronic cigarette of claim 9, wherein space is provided between the heater and an inner surface of the inner core assembly.

14. The electronic cigarette of claim 9 wherein liquid passing through the at least one opening contacts the heater and the heater atomizes the liquid.

15. The electronic cigarette of claim 9, wherein holes comprise 10 or 11 percent of the inner core assembly and ceramic comprises 89 or 90 percent excluding upper and lower openings and the heater provides resistance in a range of 0.3 to 8.0 ohms.

16. The electronic cigarette of claim 9, wherein the heater has between three and nine sides and rounded corners.

17. An electronic cigarette comprising an atomizer, the electronic cigarette comprising an inner core assembly configured to fit within the electronic cigarette, the inner core assembly configured to receive liquid and provide the liquid through at least one opening formed therein, the inner core assembly comprising:

a heater having a noncircular cross section; and connections from the heater to the electronic cigarette;

wherein the heater is formed of ceramic.

18. The electronic cigarette of claim 17, wherein the heater has a hexagonal shape with rounded corners in an external sinusoidal wave shape.

19. The electronic cigarette of claim 17, wherein holes comprise 10 or 11 percent of the inner core assembly and ceramic comprises 89 or 90 percent excluding upper and lower openings.

20. The electronic cigarette of claim 17, wherein the electronic cigarette is free of a liquid absorbing member positioned between the heater and the inner core assembly.

* * * * *